United States Patent [19]

Welker

[11] 3,945,770

[45] Mar. 23, 1976

[54] HIGH PRESSURE PUMP

[76] Inventor: Robert H. Welker, P.O. Box 1228, Bellaire, Tex. 77401

[22] Filed: Nov. 6, 1974

[21] Appl. No.: 521,263

Related U.S. Application Data

[63] Continuation of Ser. No. 321,330, Jan. 5, 1973, abandoned.

[52] U.S. Cl. ..... 417/401; 92/90; 417/479

[51] Int. Cl.[2] ..... F04B 43/00; F01B 19/00

[58] Field of Search ..... 417/479, 501, 401, 457, 417/490, 443, 556, 510, 511, 480; 116/63; 92/90, 89

[56] References Cited

UNITED STATES PATENTS

| | | | |
|---|---|---|---|
| 2,929,332 | 3/1960 | Pierce | 92/90 |
| 3,039,271 | 6/1962 | Lind | 92/101 X |
| 3,536,451 | 10/1970 | Ludwin | 417/63 X |

FOREIGN PATENTS OR APPLICATIONS

| | | | |
|---|---|---|---|
| 97,627 | 4/1961 | Netherlands | 417/479 |
| 209,227 | 7/1956 | Australia | 417/479 |

*Primary Examiner*—Carlton R. Croyle
*Assistant Examiner*—Richard E. Gluck

[57] ABSTRACT

A high pressure pumping apparatus which incorporates a chamber adapted to be filled with a fluid to be pumped, a solid, nonyieldable reciprocating member and an opposing nonyieldable member. A resilient plug having a dished out portion is captured between the two members. The dished out portion is contacted and seals to define a closed chamber at the dished portion which chamber reduces in size as the nonyieldable members are relatively moved. A small passage communicates with the dished out chamber in the resilient member to draw fluid therefrom through a check valve mechanism. The apparatus is particularly able to pump extremely small controlled volumes of fluid at very high pressures. A first version thereof supports the resilient member on a solid piston rod which moves toward a fixed metal member. A second version utilizes a diaphragm motor and also discloses an exposed push rod which gives an external indication of operation of the equipment. A third embodiment positions the check valve struture in a solid push rod which travels toward the resilient member which is held against the solid member. A control system is defined responsive to temperature and pressure.

9 Claims, 6 Drawing Figures

5
5
406
300
6
408
404
416
412
402
308
400
396
394
306
410
390
304
312
310
302
388
316
382
318
392
314
322
380
384
324
320
364
386
326
356
360
6
354
362
358
376
328
352
368
374
370
348
372
350
346
330
338
336
334
332
342
344
340

FIG. 5
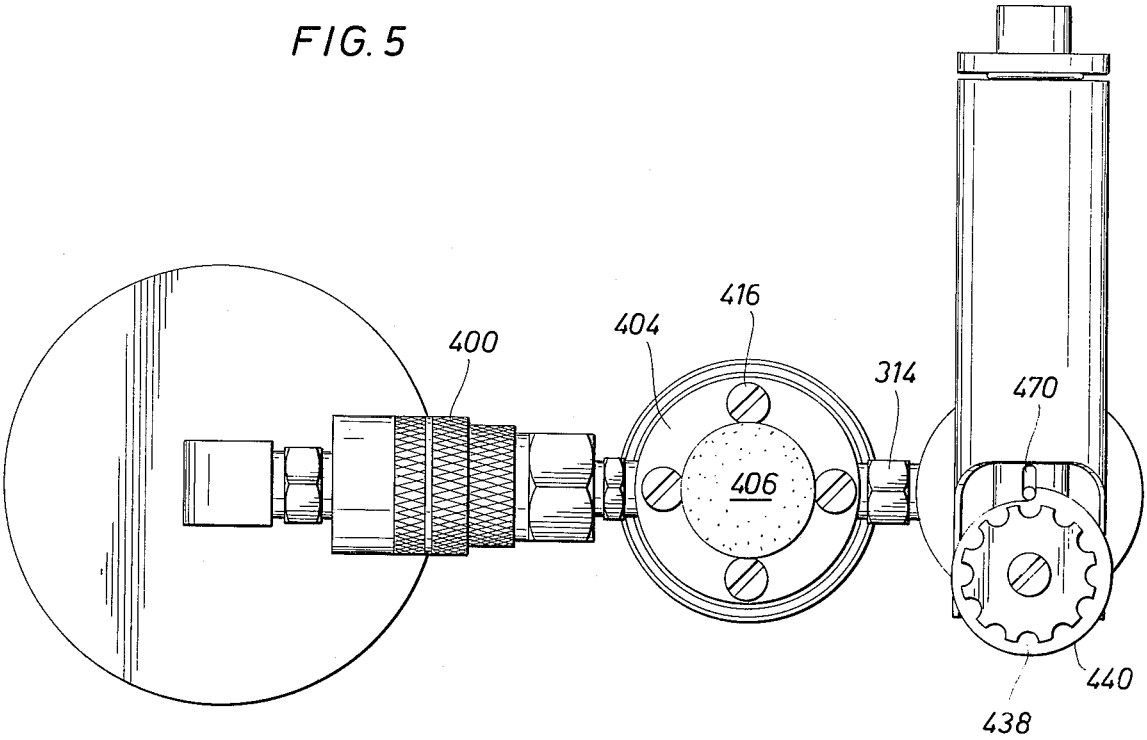
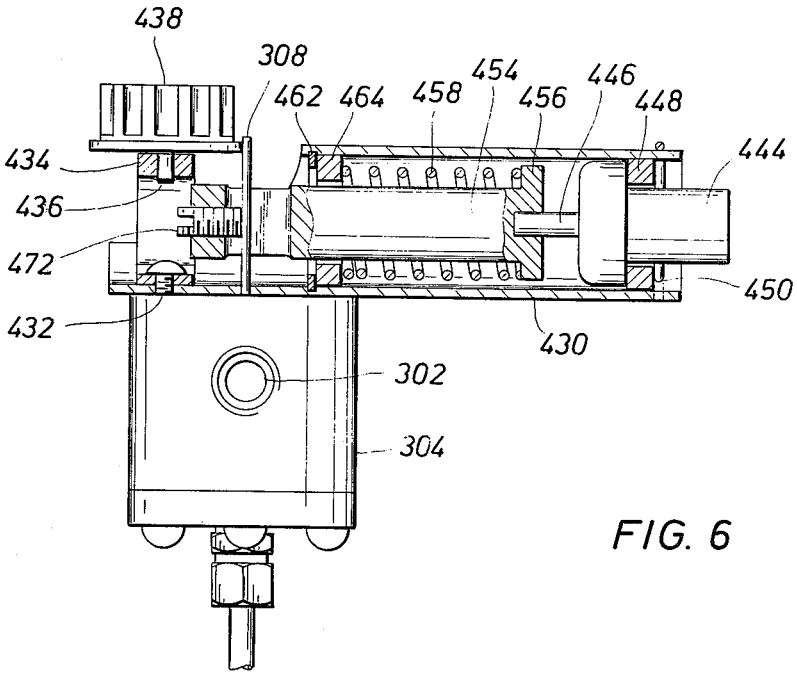
FIG. 6

HIGH PRESSURE PUMP

This application is a continuation of Ser. No. 321,330, filed Jan. 5, 1973, now abandoned.

BACKGROUND OF THE INVENTION

In the operation of chemical processes within pressure vessels, substantial internal pressures are created. It is sometimes necessary to feed minute quantities of selected additives to such processes against the internal pressure. In this event, a pump is called for which pumps a very small volume of fluid against an extremely high back pressure.

Another typical situation in which very specialized pumping capabilities are called for is in the provision of odorants such as mercaptans for natural gas flowing in a pipeline. Natural gas is odorless in the pure state. It is preferably pipelined substantial distances in the odorless condition. Typically, an odorizer is incorporated with the distribution system where the odorless natural gas is taken from a large pipeline which may travel across the country and the odorized natural gas is pumped through a city distribution system. Odorant is added as a safety precaution so that leaks are more readily detected in the multi-line distribution network. Quite often, this is even required by municipal ordinances and state laws as a safety precaution.

The reverse of the above situation is often encountered. By the reverse, reference is made to the crcumstances in which a chemical process or pipeline normally operates at substantial elevated pressures and a sample is required from within the pressure vessel or the pipeline. It is difficult to obtain a sample in small volume. Overly complex pressure regulator systems, choke systems and the like have been devised heretofore. The present invention provides a sampling pump which is uniquely adapted to remove an extremely small sample from a high pressure chamber against a relief valve utilizing the pumping apparatus described above with respect to other embodiments.

The present disclosure is directed to multiple embodiments of a pump as described above but also discloses a control system for such a pump, particularly applied and adapted for placing odorants in a natural gas pipeline. The system is also adapted for placing hydration inhibiters in pipelines to prevent the formation of ice. In such instances, the quantity of trace material to be placed in the pipeline or other pressure vessel is variable depending on multiple factors. For instance, it can be variable dependent on the temperature of the fluid under pressure, or it can be a function of temperature either of the pressurized fluid or ambient air. In any event, the control system is adapted to operate the pump of the present invention and further provide a means operating the pump of the present invention at a controlled rate.

| Prior Art | |
|---|---|
| 1,830,643 | 3,469,594 |
| 3,520,477 | 1,949,497 |
| 1,736,645 | 1,977,654 |

SUMMARY OF THE INVENTION

The present invention is summarized as providing multiple embodiments of a pump particularly adapted for pumping fluids in extremely small volumes at high pressures. The three embodiments share in common a chamber in which to capture or contain a fluid to be pumped and a pair of metal members which are moved relative to one another. A resilient member is placed between the metal members which are structurally rigid. The resilient member contacts one of the two metal members. A dished chamber is formed in either the resilient member or the contacting metal member. The dished out chamber is adapted to receive and capture a small portion of the fluid to be pumped. The chamber seals about the edge when the resilient member first contacts the opposing metal member. As the two metal members are brought closer together, the resilient material flows into the chamber to reduce its size, thereby expelling fluid from the chamber under extremely high pressure through a small passage and a check valve mechanism. The apparatus is reciprocated to repetitively pump fluid past the check valve. A first embodiment incorporates a reciprocating piston rod which captures a resilient member having a hemisphere dished in its exposed face where the resilient member is captured in a sliding sleeve to maintain desired placement and the piston rod carries it against an unyielding opposite wall having a check valuve mechanism therein. The first embodiment is operated by introduction of pressure fluid to a piston having substantially larger area than the piston rod to obtain force multiplication.

The second embodiment utilizes a diaphragm motor which works a similar piston rod which drives a resilient plug having a dished out face against the opposing opposite metal wall. A small passage is located opposite the indentation in the resilient member and fluid is forced past a check valve through the small passage. The check valve is equipped with a small rod which extends from the pump structure to enable inspection of the equipment to determine whether or not it is pumping. A third embodiment supports the resilient member in a fixed cylindrical housing which surrounds it. It is adapted to be placed in a pressure vessel for sampling. A piston rod having a check valve mechanism centrally positioned in it reciprocates against the resilient plug. A sample of fluid is captured as the indentation in the resilient plug disappears and the sample is forced past the check valve to sample receiving apparatus. A control system is disclosed which is responsive to pressure and temperature. It is adjustable so as to control the pumping rate.

BRIEF DESCRIPTION OF THE DRAWINGS

FIG. 5 is a sectional view taken along the line 5 — 5 of FIG. 4 disclosing details of the adjustable mechanism; and FIG. 6 is a sectional view taken along the line 6 — 6 of FIG. 4 disclosing details of construction of a metering valve mechanism cooperative with a pressure and temperature responsive apparatus which controls the pumping rate.

DESCRIPTION OF THE PREFERRED EMBODIMENTS

Figure 1:
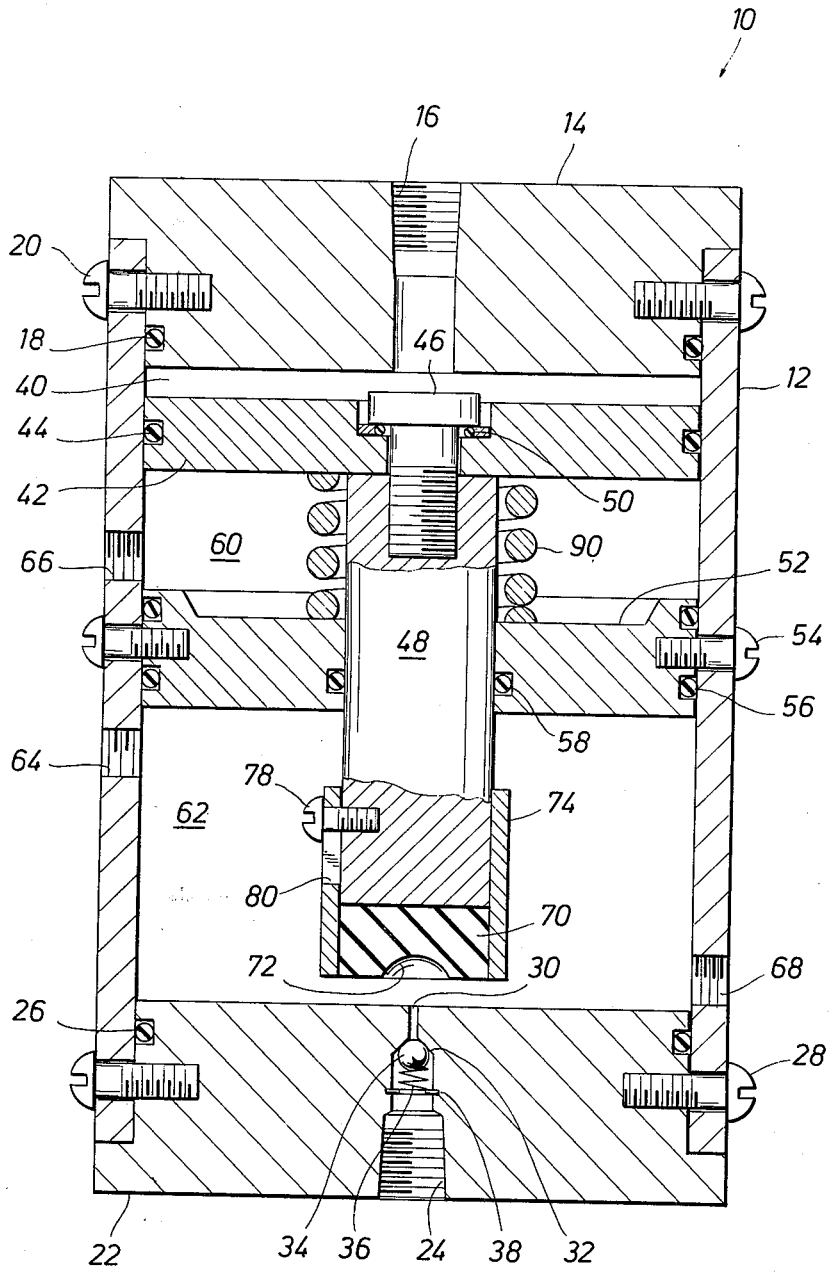
FIG. 1 is a sectional view through a first embodiment of the high pressure, low volume pump of the present invention, particularly disclosing a piston rod, a resilient plug having an indented face and an opposing fixed metal wall, all operable in response to a reciprocating piston having enlarged area.

Before beginning a description of the specific embodiments disclosed herein, certain common features will be mentioned prior to a description of FIG. 1. The common structural features found in the high pressure, low volume pump of the present invention particularly center around the use of a resilient plug which works against a metal face. A chamber, preferably shallow and fairly broad, is dished out either of the resilient plug or of the opposing metal face. A piston rod is preferably incorporated to provide relative motion between the resilient plug and the opposing metal face. This structure is placed in the fluid to be pumped. One suitable technique is to submerge the above described apparatus in fluid to be pumped, typically captured in a closed container. As the resilient member is forced against the opposing metal face, the resilient member deforms and the cavity disappears. As it disappears, fluid is pumped from the cavity through a small opening and a check valve mechanism. The check valve mechanism determines the necessary back pressure and of course, prevents return of the fluid when the resilient member is relaxed and the chamber or cavity reforms.

With the foregoing in mind, attention is first directed to FIG. 1 of the drawings where a first embodiment of the pump of the present invention is indicated by the numeral 10. The pump includes a cylindrical tubular body 12 and extends from a top plate 14 which is tapped at 16 to define an inlet passage. The passage 16 is adapted to be connected with a pressure source to obtain a pressure fluid which operates the pump. This is to be distinguished from fluid which is to be pumped. The top plate 14 is sealed in the upper end of the tubular member 12 by means of a seal member 18. The top plate 14 is a cylindrical plate having an overlapping flange which abuts the upper end of the tubular member 12. It is held in position by a number of bolts 20 which are spaced at various points about the periphery.

The housing of the pump is defined at its lower end by means of a bottom plate 22 having a tapped opening 24 which is the outlet passage of the pump of the present invention. The opening 24 is adapted to be connected with the apparatus which requires the pumped fluid in accordance with the present invention. The bottom plate 22 is sealed within the tubular shell member 12 by means of a seal 26 which is preferably an O-ring received in an external groove about the bottom plate 22. The bottom plate 22 is secured in position by a number of bolts 28 about its periphery.

The bottom plate preferably incorporates a centered passage 30 which extends to a valve seat 32 which is closed by means of a spherical valve member 34. The valve member 34 is forced upwardly by means of a spring 36 which rests on a snap ring insert 38. The snap ring forces the valve member against the seat to secure it in position. The valve arrangement illustrated functions as a check valve which permits flow of fluid from the small passage 30 through the tapped opening 34. It forbids flow in the opposite direction.

The tapped opening 16 at the top of the device opens into a chamber 40 which is above a large piston 42. The large piston 42 slidably moves within the tubular housing. Leakage past the piston is prevented by an O-ring 44 received in a groove on the outer edge of the piston. The piston 42 is slidable up and down within the chamber defined by the tubular housing in response to changes in pressure introduced through the opening 16. The piston 42 has a very substantial area so that a force of some magnitude is formed on its upper surface when pressure is introduced into the chamber 40. The piston 42 is drilled at a central location and a bolt 46 extends therethrough and connects with a piston rod 48. The bolt 46 threads into the rod 48 and joins the piston rod 48 to the piston 42. The piston rod 48 functions as a piston rod in transferring the force from the piston 42. However, it functions as a piston in its own right, as will be noted in describing the lower portions hereinafter. Leakage through the piston 42 is prevented by means of a seal member 50 positioned below the head of the bolt 46.

A splash guard 52 spans the width of the chamber below the piston 42. The splash guard 52 is anchored in position by means of bolts 54. A seal member 56 is on the outer edge of the splash guard 52. A seal member 58 is on the inner edge of the splash guard 52. Perfect seals are not required at the splash guard. The splash guard defines an upper chamber 60 and a lower chamber 62. The fluid to be pumped is preferably introduced into the lower chamber 62 through a port or opening 64. The upper chamber 60 is preferably vented to atmosphere or a sump return through a passage 66. The splash guard 52 preferably keeps the fluid to be pumped in the lower chamber. If the fluid gets on the top side of the splash guard, this is of no particular consequence other than it may be somewhat wasteful of the fluid to be pumped. To this end, the passage 66 opening into the upper chamber can be connected to a sump or accumulator of the fluid which escapes past the splash guard. The seals or the splash guard itself can be omitted; however, the splash guard serves a useful purpose in keeping the fluid to be pumped in the lower portions of the chamber, minimizing bubbles of foaming on its surface and further surrounding the lower end of the piston rod 48 with the fluid to be pumped. For drainage, an additional port 68 is provided opening into the lower portions of the pumping chamber 62.

The lower end of the piston rod 48 serves as the piston. The lower end is placed in an abutting relationship to a resilient member 70. The resilient member 70 is formed of a resilient material such as butadiene. It has a durometer which may range perhaps as low as twenty to as high as about ninety. The resilient member 70 incorporates a dished out cavity 72. The cavity 72 is contoured to have gentle curves and is faired smoothly into the face of the resilient member 70. The resilient member 70 does not need to be fixedly attached to the piston rod 48. It is preferably captured snugly within a telescoped tubular member 74. The member 74 is held relative to the piston rod by a bolt 78. The bolt 78 extends through a slotted opening 80 in the telescoped tubular member 74. The member 74 tends to capture the resilient pump face 70. It is captured in a manner permitting it to flex and distort in response to pressure, and yet is maintained in a working relationship to the piston rod 48.

A return spring 90 forces the piston rod 48 upwardly, moving the apparatus toward the illustrated position.

In operation, the chamber 62 is filled with a fluid to be pumped. The fluid to be pumped may be any sort of fluid, and need only be introduced under low pressure to fill the chamber. Once the chamber 62 has been filled to a point which at least submerges the face of the resilient pump member 70, the piston rod 48 is forced downwardly. As it moves downwardly, the resilient member 70 retains its illustrated shape and form until it contacts against the exposed face of the bottom plate 22. At this juncture, a seal is formed fully about the cavity 72 by contacting the resilient member 70 against the bottom plate 22. As the piston rod 48 moves further downwardly, the resilient member 70 begins to deform and the cavity 72 formed in the space begins to disappear. As the cavity 72 disappears, the fluid which has been captured in the cavity is forced into the passage 30. The apparatus is able to pump fluid against a back pressure of several thousand psi. Eventually, the resilient member 70 deforms to an extent that the cavity 72 apparently fully disappears. The piston rod 48 can then be retracted and moved upwardly. When it moves upwardly, the resilient member 70 is restored to its illustrated shape. The resilient member 70 maintains the illustrated cavity only in a relaxed posture.

The piston rod 48 is reciprocated in one technique by introducing pressure fluid into the upper chamber 40. The fluid pumping rate can be varied to alter the pumping rate of the apparatus. Fluid is introduced into the upper chamber under pressure for a timed interval. The pressure is then released and later re-introduced to pump cyclically through movement of the upper piston 42. This movement is imparted to the piston rod 48. When the pressure in the upper chamber is reduced, the spring 90 returns the piston 42 to its up position.

While the illustration shows a hydraulic or pneumatic system for reciprocating the pump of the present invention, different apparatus can be incorporated for operating the pump. For example, an eccentric pumping mechanism can be used to force the piston rod 48 upwardly and downwardly.

It will be noted that the splash guard 52 tends to keep the fluid to be pumped at high pressure in the lower chamber 62. In some instances, it can be omitted.

Figure 2:
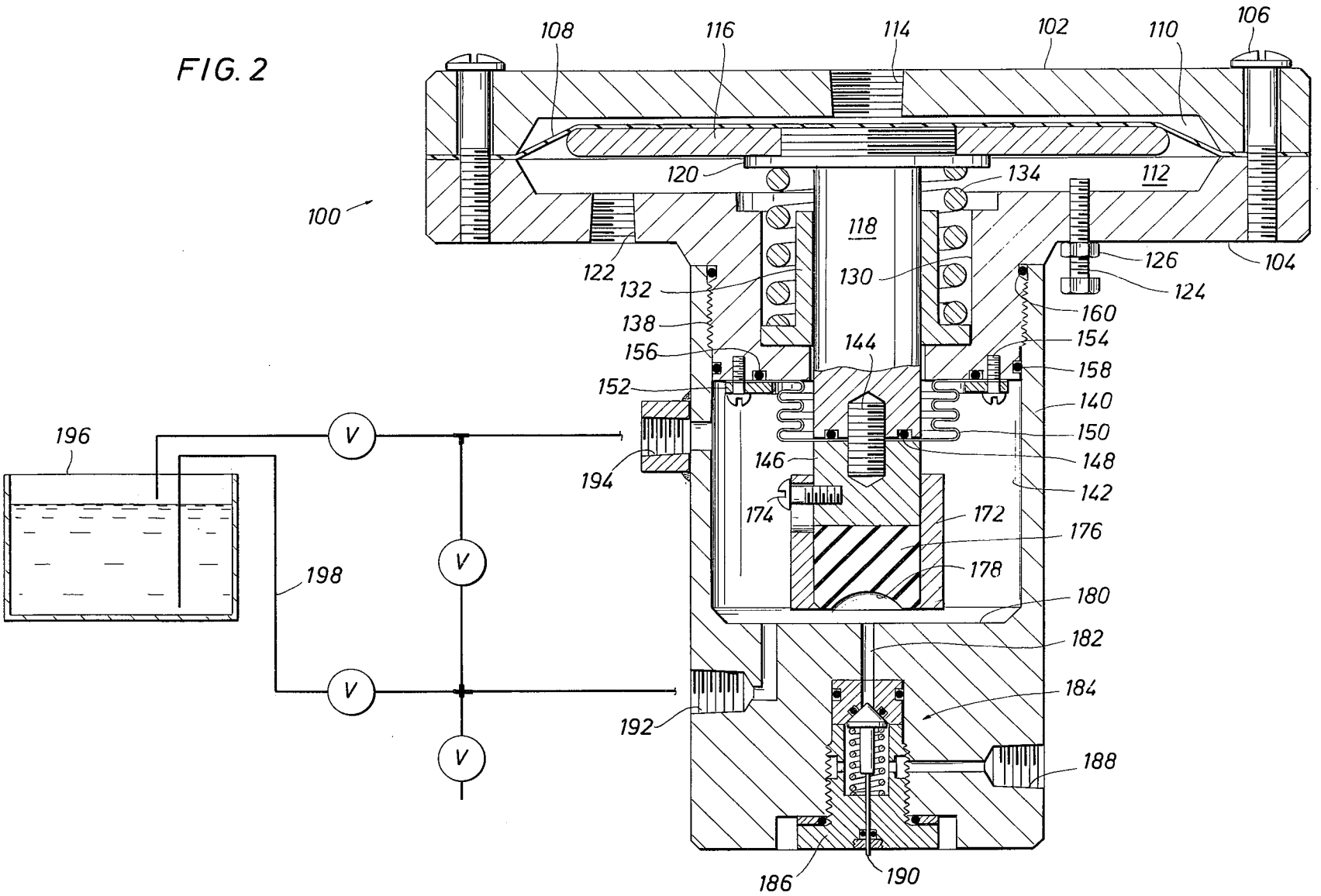
FIG. 2 is an alternative embodiment to the structure of FIG. 1 showing a diaphragm motor operating a similar piston rod working against a resilient plug and further including a check valve motion indicator to enabling checking of the operable state of the pump.

Attention is next directed to FIG. 2 of the drawings where the numeral 100 identifies a second embodiment of the present invention. The embodiment of FIG. 2 has a diaphragm motor to be contrasted with the piston motor which serves as the prime mover for the embodiment 10 shown in FIG. 1. Considering FIG. 2 in greater detail, the numeral 102 identifies a top housing which is joined opposite a lower diaphragm housing 104. The two housings are joined together by bolts at 106. The housing members 102 and 104 are preferably circular and the bolts are arranged in a circle about the periphery. The two circular members are brought together and capture a diaphragm member 108. It spans fully across an internal chamber and divides the chamber into two portions, the upper portion being indicated by the numeral 110 while the lower portion is indicated by the numeral 112. The diaphragm 108 separates the chambers 110 and 112. The numeral 114 identifies a port thorugh which pressure fluid is introduced to operate the diaphragm motor to be described. It is located in the upper housing member 102.

The chamber 112 incorporates a circular disc 116 which is threaded to a piston rod 118. The rod 118 has a collar 120 which limits threaded engagement of the disc 116. The disc 116 is only slightly smaller than the diameter of the diaphragm 108 within the chambers. When the pressure fluid is introduced through the port 114 to the top chamber 110, it impinges on the diaphragm 108 and forces it downwardly. The downward motion or force is conveyed to the disc 116 which then imparts it to the piston rod 118. More will be noted concerning this hereinafter.

The lower chamber 112 is communicated to atmosphere through a port or opening 122. Alternatively, the tapped opening 122 can be connected with a back pressure source to control the pressure differential acting acorss the diaphragm 108. The range of travel of the piston rod 118 is limited by means of an adjustable stop 124 which is shown at the right hand side of FIG. 2. The stop 124 preferably comprises a bolt which threads through the lower housing member 104. A lock nut 126 is incorporated to hold it at a specified position. This lock mechanism limits the range of travel of the diaphragm motor and hence, the deformation of the resilient member in the high pressure pump to be described.

The lower housing 104 incorporates an axial passage which is enlarged at 130. A guide bushing 132 is positioned therein. It has a lower shoulder which extends outwardly to receive a coil spring 134. The spring 134 forces the disc 116 and the connected piston rod 118 upwardly as viewed in FIG. 2 of the drawings. Downward movement is accomplished against the force of the spring 134. This, of course, if achieved when fluid under pressure is introduced above the diaphragm 108.

The lower housing member 104 is threaded on its exterior at 138 and a cylindrical body 140 is joined to it. The body 140 defines an internal chamber 142. The piston rod 118 extends downwardly into the chamber 142. However, the piston rod 118 is preferably formed of multiple components to enable interposition of a seal to prevent leakage along the piston rod 118. The rod 118 terminates within the chamber 142 and has an internal tapped opening for receiving a headless bolt segment 144. The bolt 144 joins a second portion of the piston rod 146. The upper portion of the piston rod is grooved at 148 to receive O-ring for sealing purposes. A bellows shaped diaphragm 150 is caught adjacent to the O-ring seal 148 between the two cylindrical members which comprise the piston rod. The diaphragm 150 has a number of bellows which accommodate vertical reciprocation of the piston rod 118.

Three or four bellows are illustrated in FIG. 2 although the number can be varied. In any case, the diaphragm 150 elongates with the piston rod as it moves upwardly and downwardly.

The diaphragm seal 150 flares outwardly at its upper end and abuts the lower end of the lower housing member 104. It turns up and forms an encircling shoulder at 152 and a number of bolts indicated at 154 anchor the diaphragm lip 152 against the bottom side of the cylindrical lower housing member 104. To prevent leakage, O-ring seals are incorporated at 156, 158, and 160. The plurality of O-ring seals mentioned above all prevent leakage either along the piston rod 118 or between the components of the structure including the lower housing 104 or the cylindrical housing 140.

As described to this juncture the piston rod can be reciprocated upwardly and downwardly within the chamber 142. Leakage, of course, is prevented by means of a diaphragm seal structure 150 described above. The lower end of the piston rod including the portion 146 supports a sliding sleeve 172. The sleeve 172 is held in position by means of a bolt 174 which extends through a lengthwise slot in the sleeve 172. The bolt 174 limits the relative movement of the sleeve 172 with respect to the piston rod. The sleeve 172 captures a resilient plug 176. The resilient plug 176 has a dished, exposed face 178. The face 178 is exposed to an opposing metal face 180 which comprises a portion of the cylindrical housing member 140. As mentioned above, the dished out portion is formed in the resilient member although the location could be reversed, namely, it could be placed in the opposing metal face 180. In any event, a dished out face is defined within a surrounding shoulder which makes first contact. This helps capture fluid in the chamber 142 within the smaller dished out receptacle 178 so that the fluid can be pumped from the pump under extremely high pressure as the dished out chamber 178 disappears. It will be observed that the sleeve 172 has an inwardly projecting lip for purposes of capturing the resilient plug 176 to prevent it from dropping from the sleeve 172. Preferably, the plug fits fairly snuggly within the sleeve. However, because of variations in temperature, rubber creep and the like, the resilient plug 176 is preferably captured.

The cylindrical housing has a small passage 182 which extends to a check valve mechanism at 184. The check valve mechanism 184 incorporates a check valve structure having a valve seat, a conforming valve member, an O-ring seal in the valve seat to provide a good seal, a spring working against the valve member and a threaded plug structure 186 for assembling all of the described apparatus in the illustrated arrangement. The plug 186 threads into a capped opening within the cylindrical housing 140. It is preferably perforate at least one or two locations to communicate with a lateral port 188 permitting connection with appropriate conduits for delivery of fluid under high pressure.

The check valve structure should be particularly noted with regard to a protruding rod 190. The rod 190 is connected to the valve element itself. The spring which is illustrated in FIG. 2 forces the valve element upwardly against the seat. It remains in the up position indefinitely until the pump actually reciprocates and pumps fluid past the valve element. As the fluid is forced against the valve element and the spring below, it forces the element from the valve seat. When fluid is forced past the valve element, the rod 190 is reciprocated downwardly. This serves as a practical external indicator signalling an operator that the pump is operative and pumping the specific fluid. This is particularly to be contrasted with transparent or optical sight glasses which are a good deal more complicated and expensive to install, maintain and service. The indicator rod 190 can be easily tested by an operator by simply placing his finger against the rod 190 and feeling the oscillations which occur as the pump operates.

From the foregoing description, it will be observed how the indicator rod 190 provides a physical indication of operation of the high pressure pump of the present invention. It can be readily touched to determine if the pump 100 is pumping fluid. This is particularly advantageous if the source of fluid to be pumped cannot be readily observed and it occasionally runs dry. The indicator rod 190 is observed to extend through an O-ring seal and a threaded plug which locks the seal in position. The larger plug 186 is also sealed by a number of O-rings to maintain integrity against leakage.

The numerals 192 and 194 identify ports which communicate with the chamber 142. They communicate with the distribution system extending from a gravity fed tank 196 which delivers fluid to be pumped by means of a siphon line 198. A return line is also provided. Preferably, the tank 196 is stored at a raised point with respect to the pump 100 so that siphon flow is maintained through the line 198. The line 198 preferably connects with the inlet port or tapped opening 192. This introduces fluid to the chamber 142. The fluid introduced to the chamber need not be pressurized to any particular level. In the event that surplus fluid is introduced to the chamber 142, it can be returned through the port 194. The reciprocation of the piston rod 118 and the movement of the diaphragm seal 150 tends slightly to expand and contract the space within the chamber 140. This forces some slight flow of surplus fluid out through the port 94 and back to the tank 196. As required, appropriate valves are included in the multiple lines extending from the port 192 and 194 to the tank 196.

Figure 3:
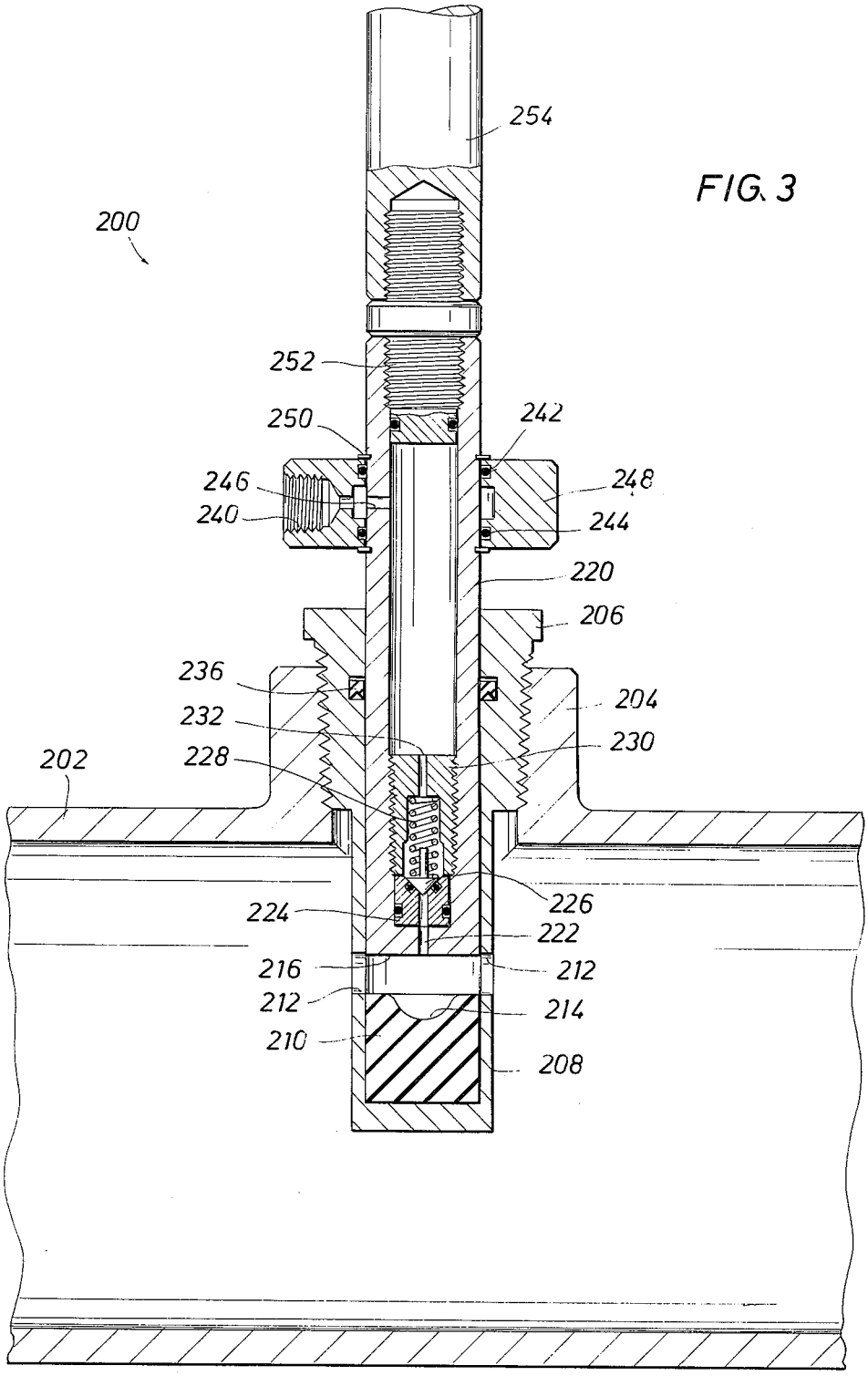
FIG. 3 is a sectional view of a third embodiment of the pump of the present invention particularly adapted for sampling purposes in a high pressure vessel or pipeline wherein the resilient plug is maintained stationary and is captured in a cylinder which has ports for introducing the fluid to be sampled.

Attention is next directed to FIG. 3 of the drawings where the numeral 200 identifies a third embodiment of the pump of the present invention. This embodiment is particularly adapted for use as a sampling device for removing fluid from a container at extremely high pressures. The pump 200 may be installed in a pipeline such as that indicated at 202. It may also be installed in a pressure vessel at any suitable point where it is exposed to the fluid that is of interest.

The embodiment 200 cooperates with a threaded fitting 204. The fitting 204 opens into the pipe 200. The fitting 204 receives a hollow adaptor 206 in threaded engagement. The hollow adaptor 206 has a lower cylindrical chamber indicated at 208. The chamber 208 is hollow and receives a resilient plug 210. The chamber 208 is preferably cylindrical in crosssection and is closed across the bottom as illustrated in FIG. 3. The hollow passage in the adaptor 206 opens upwardly from the chamber 208. The resilient plug is positioned therein just below a number of ports or openings indicated at 212. The ports or openings enable fluid which is to be pumped by the sampling pump to enter into the chamber 208 adjacent to the resilient plug 210.

The plug 210 preferably has a dished out face at 214. It is positioned immediately opposite to the working face 216 of a piston rod. The face 216 functions in the same manner as the opposing face 180 shown in FIG. 2. By way of contrast, however, the face 216 reciprocates while the face 180 shown in FIG. 2 is held stationary while the resilient member is reciprocated. The face 216 is on the lower end of an elongate piston rod 220. The piston rod reciprocates upwardly and downwardly through the axial passage in the threaded adaptor 206. The piston rod is hollow beginning at the bottom where it has a small passage 222 extending upwardly to a valve seat member 224. The valve seat member 224 contracts a valve member 226. The valve member 226 is forced downwardly against the valve seat by means of a resilient spring 228. The spring 228 determines the bias against which the pump operates when it takes a sample from the pipeline 202.

The spring 228 is received within a hollow chamber adjacent to the seat member 224. The seat member 224 is received below a threaded plug 230 within the hollow piston rod. The plug 230 has a small passage 232 formed therein which extends upwardly above the threaded plug which completes assembly of the check valve mechanism. It will be observed that the relief valve mechanism is conveniently located within the piston rod 220.

The numeral 236 identifies a chevron packing on the exterior of the piston rod 220 to prevent leakage along the rod. The piston rod 220 will be observed to be hollow above the check valve mechanism. This provides an axial passage to a lateral tapped opening 240. The opening 240 is in a fitting which is sealed by means of encircling O-rings 242 and 244 to the piston rod 220. A small opening 246 is formed in the side wall of the piston rod to the fitting which is thereabout. The fitting is indicated by the numeral 248 and is held in position by a number of snap rings 250.

The upper end of the piston rod is closed by a plug 252. The plug enables connection to an additional rod 254 extending thereabove.

A typical power source is connected to the rod 254 to force the piston rod upwardly and downwardly at a desired rate. As illustrated, the piston rod 220 is free to slide upwardly, completely out of the threaded adaptor 206. It is held in position by means of a reciprocating power source such as the power sources illustrated in FIGS. 1 and 2. For instance, FIG. 1 discloses a pressure fluid operated pump having a piston of substantial cross-sectional area to enable a substantial reduction in the pressure required to operate the pump. FIG. 2 illustrated a diaphragm motor which can be used. In any event, the piston rod 220 is forced downwardly by means of some suitable motive source. It can even be hand operated if desired. Moreover, suitable supporting structure is incorporated, not shown, which prevents the piston rod 220 from being ejected by the pressure within the pipe 202.

In operation, the sampling pump functions similar to the structures described heretofore. The sampling pump is mechanically operated to reciprocate the piston rod 220. When the rod moves downwardly, the metal face 216 contacts the resilient member 210. The resilient member is deformed and the recess 214 disappears. It first captures a small quantity of the fluid to be sampled inasmuch as the first contact between the opposing face 216 and the resilient member 210 is about the periphery of the dished chamber. This captures some of the fluid. As the piston rod moves further downwardly, the encircling shoulder of contact becomes larger as the resilient material deforms. This is accomplished while fluid is forced from the chamber into the passage 222 and past the check valve mechanism.

Figure 4:
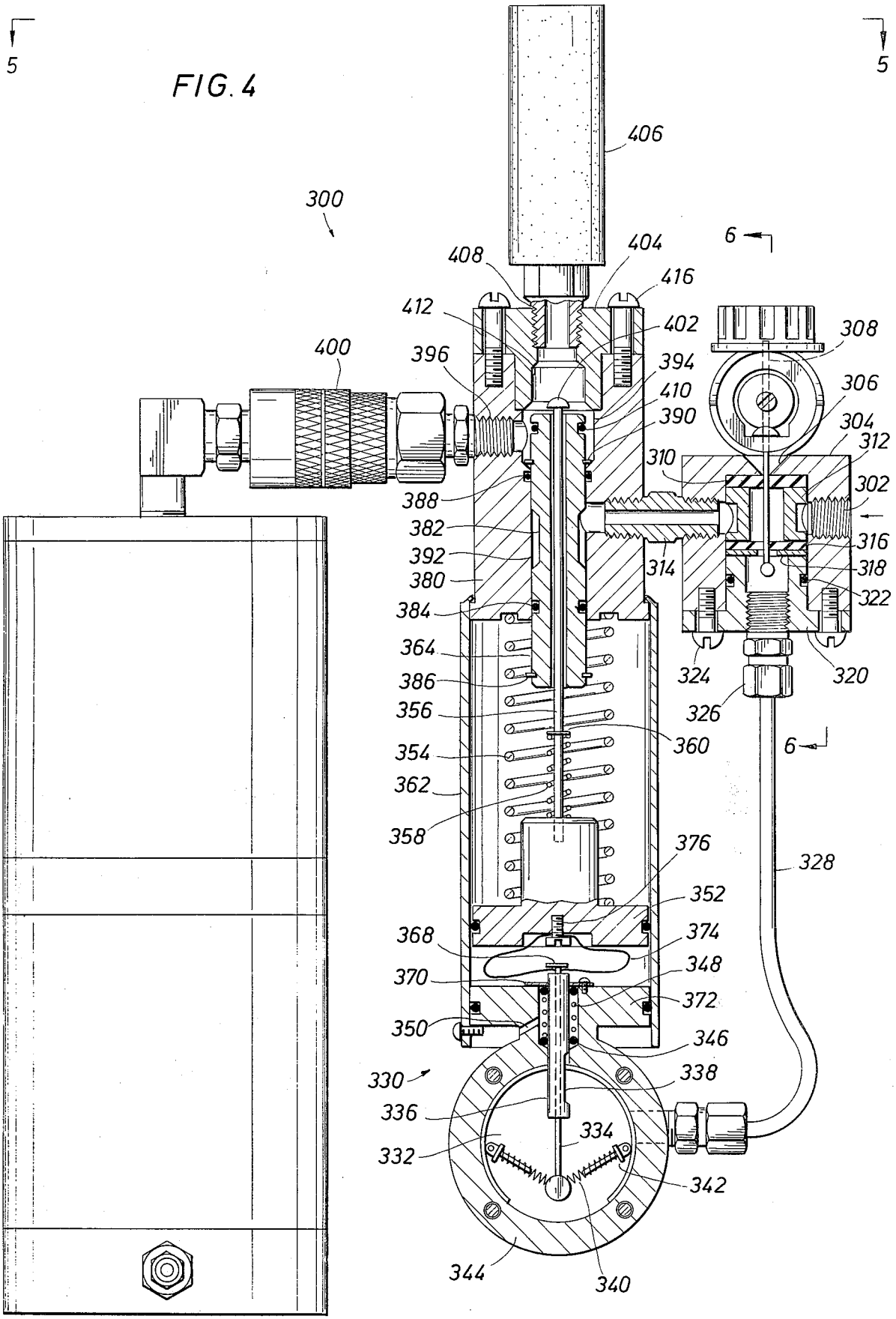
FIG. 4 is an assembly drawing, partly in section, of a pumping rate control mechanism which is responsive to pressure and temperature variations and which is made adjustable to provide the requisite pumping rate.

Attention is next directed to FIG. 4 of the drawings where the numeral 300 identifies a mechanism for controlling one of the embodiments of the pump which has been described to this juncture. The control apparatus 300 will be described very briefly and then will be described in detail. Gas under pressure is introduced to a control valve which has a control rod extending from it. The control rod is engaged by a control mechanism which is rotated to set the control valve. The valve forms a metered or controlled flow. The control rod of the valve is captured by a temperature responsive device. The yoke moves the control rod to thereby alter the setting of the control valve.

The control valve meters flow to a reversing mechanism. If the flow to the reversing mechanism is increased, it operates at a greater rate of speed. The reversing mechanism is connected to a spool operated valve. The spool operated valve is supplied with gas under pressure. It attains two positions, a closed position and an opened position. The two positions modulate gas flow to the pump of the present invention. It is supplied in pulses or surges. The slide valve also provides a vent to atmosphere which exhausts the high pressure pump after gas has been applied to it. The pump is cyclically operated at a rate which is determined by the setting on the metering valve and the temperature responsive device.

A detailed consideration of the structure shown in FIG. 4, the numeral 302 identifies an inlet port in the metering valve assembly 304. The metering valve assembly is more fully disclosed and is claimed in copending patent application of the same inventor. The metering valve 304 has a tapered opening 306 from which a control rod 308 extends. The rod is supported in the tapered opening by a resilient diaphragm 310. The diaphragm 310 fits snuggly about the rod. A viewed in FIG. 4, the rod pivots about the tapered opening 306. Leakage along the rod through the tapered opening is prevented by the resilient diaphragm 310.

The diaphragm 310 is received within an internal cylindrical chamber in the valve 304. It is clamped in position by a circular insert 312 within the cylindrical chamber. The circular insert 312 bears on the periphery of the diaphragm 310 to clamp it in position. Moreover, it is perforated at spaced locations along its tubular body to admit gas to the interior of the valve. It also provides a flow path from the inlet port 302 to an opposing outlet port where a fitting 314 communicates the gas on the other apparatus to be described.

The interior of the valve 304 is divided into two separate chambers which are selectively communicated by the control rod 308. A second diaphragm 316 fits snuggly about the lower end of the control rod 308. The diaphragm 316 is supported by a metal backing member 318. The backing member supports the diaphragm 316. It additionally has an opening formed in it which is larger than the control rod 306. The opening can be an elongated slot, for instance, to enable the control rod to be pivoted at its point of emergence from the upper diaphragm 310. As the control rod 308 is moved, it distorts the lower diaphragm 316. In the neutral or center position, the diaphragm 316 fits snuggly about the control rod and prevents leakage of gas past the diaphragm. However, when the control rod is deflected, the opening is distorted and gas flows past the diaphragm and the support disc 318.

The numeral 320 identifies a tubular fitting received within the body of the valve 304 which is forced upwardly against the back up disc 318. Clamping action is created about the periphery of the disc 318 and the diaphragm 316. This prevents leakage around the edge of the diaphragm. Moreover, the hollow threaded insert 320 is equipped with an O-ring seal 322 which prevents leakage along its exterior. The member 320 has a surrounding flange enabling bolts to secure the members together in a leakproof arrangement. The numeral 326 identifies a pipe fitting which connects into the outlet port in the member 320 and a conduit 328 delivers a controlled volume of gas to a reversing mechanism.

The reversing mechanism 330 incorporates a hollow chamber 332 where gas from the line 328 is introduced. The numeral 334 identifies a push rod or stem which supports a tubular valve body 336. The valve body 336 is notched at 338. The push rod 334 connects to an enlargement at its lower end which is joined to a compressed spring 340. The spring 340 surrounds a rod extending from a pivot 342. This arrangement is duplicated on both sides. Thus, as the stem 334 moves upwardly, it must compress the springs 340. The springs are compressed as they rotate at the pivot connections at 342.

Gas which is introduced to the chamber 334 forces the stem 334 and the sleeve 336 from the chamber. The notch 338 spans the surrounding housing 334. An O-ring 346 held in position by a spring 348 maintains the seal about the sleeve 336. However, when the sleeve 336 moves upwardly, gas leaks through the notch 338 and past the seal 346. Some of the gas is vented atmosphere through an opening 350. However, as the stem and sleeve move upwardly, they engage a piston 352 and force it upwardly. The piston 352 moves upwardly against a return spring 354. Its upward movement is also imparted to a push rod 356 extending from the piston 352. The rod 356 centers a bumper spring 358 and a washer 360 positioned about the rod. Their function will be explained later.

As gas is introduced into the chamber 332, it forces the stem 334 from the chamber. Movement of the stem upwardly encounters an increasing force as the springs 340 are compressed. However, when the springs align horizontally as viewed in FIG. 4, they thereafter provide snap action movement to the stem. The stem then moves quickly upwardly past the stalled dead center position. As it moves upwardly, it forces the piston 352 upwardly. The piston 352 moves upwardly within the surrounding shell 362. The piston 352 moves upwardly eventually until the bumper spring 358 engages a slide valve 364. The slide valve 364 is moved upwardly by the piston. It will be observed that the movement is actually imparted through the bumper spring which is compressed to some extent during engagement.

At this juncture, the sleeve 336 is in the up position so that the notch 338 vents gas from the chamber 332 through the port 350 and to atmosphere. As pressure in the chamber 332 is relieved, the stem moves downwardly and carries the sleeve 338 with it. It moves downwardly to the position where the springs 340 are horizontal. It snaps past this position and returns to the illustrated position in FIG. 4.

The stem 334 has an enlarged head 368 at its upper end which forces the sleeve 336 downwardly. The sleeve passes through a guide disc 370 which is secured to a head 372 in the structure. The enlargement 368 provides a place to anchor a resilient member 374 which extends to the piston 352 and is connected to the piston by means of a bolt 376 which clamps the resilient member to the piston 352. A suitable resilient member is a rubber band.

The piston 352 is pushed upwardly by the stem 334. Because the stem is returned to its illustrated position rather rapidly, the resilient member 374 is stretched and pulls the piston 352 from its raised position back to the illustrated position of FIG. 4. The resilient member stretches when the stem 334 returns by snap action.

It will be understood and observed how the reversing mechanism 330 operates in a continuous manner to move the piston 352 upwardly and downwardly. This motion will next be considered in the operation of the slide valve 364.

The shell 362 is joined to a valve body 380 which supports the slide valve 364. The fitting 314 communicates with an inlet port which opens to a groove 382 cut in the slide valve 364. Leakage toward the piston 352 is prevented by means of an O-ring seal 384. Upward movement of the slide valve is limited by a snap ring 386.

The numeral 388 identifies a seal in the body 380 which surrounds the slide valve. Downward movement of the slide valve is limited by a snap ring 390 which moves to a limiting position as illustrated in FIG. 4 in a counter sunk opening. The body 380 has a central axial passage 392 which is enlarged at 394. The enlarged counter-drilled axial passage communicates with a lateral port 396 which supplies gas at a time modulated rate through suitable connective fittings 400 to the high pressure, low volume pump in accordance with the teachings of the present invention. The pump is shown in FIG. 4 and details are, of course, included in FIGS. 1, 2 and 3.

When the slide valve 364 is moved upwardly, the neck 382 of reduced diameter spans the inlet port and the O-ring 388. This then communicates the inlet port with the outlet port 396. Gas then flows through the outlet. The neck 382 spans the O-ring 388 for an interval sufficient to supply enough gas to the pump of the present invention to cause it to operate through one cycle. This gas continues to flow until the slide valve is moved away from the described position back towards the illustrated position.

Slide valve 364 is returned downwardly by the push rod 356. More particularly, the rod 356 passes fully through the slide valve 364. Its upper end has an enlargement 402 which forces the slide valve downwardly when the piston 352 moves down. It will be recalled in the description of the piston 352 that it moves downwardly because of the tug of the resilient member 374. This pulls the push rod 356 down and returns the slide valve 364 to the illustrated position.

When the slide valve 364 is in the illustrated position, the pump is vented to atmosphere. The pump is vented through the fittings 400 and the outlet port 396 back to the counter-drilled enlarged axial bore 394. This communicates with an axial passage in a fitting 404. A muffler 406 is threaded into the fitting 404 by means of connective fitting 408. The fitting 408 continues the passage from the pump into the muffler and then to atmosphere.

The fitting 404 is particularly adapted to the sealed when the slide valve 364 is in the up position. To this end, the numeral 410 identifies an encircling O-ring which fits within the fitting passage 412. The passage 412 tapers at a central point to a smaller diameter to prevent further upward movement of the slide valve 364. The fitting 404 is joined to the valve body 380 by suitable bolts 416.

In operation, the valve 364 modulates gas flow to the outlet ports 396. When it is in the illustrated position, no gas is delivered to the pump. Rather, gas is vented from the pump to atmosphere through the muffler 406. The escape route has been described above. When the slide valve 364 is in the up position, the inlet port is communicated by the neck 382 of the valve with the outlet port 396. This delivers gas through the pump to cause it to operate. It will be observed that the fitting 314 directly connects the inlet of the valve just described to the metering valve 304 previously mentioned.

Attention is next directed to FIG. 6 of the drawings where the metering valve 304 is shown. As will be recalled, the metering valve has a control rod 308 which extends upwardly. The control valve rod passes through a cylindrical body 430. The cylindrical body 430 is bolted at 432 to the control valve 304. The hollow body 430 is cylindrical. It has an internal enlargement 434 which supports a shaft 436 on which a control knob 438 is mounted. The control knob 438 rotates about the shaft 436.

Attention is momentarily directed to FIG. 5 where the control knob 438 is illustrated to have a non-circular peripheral edge 440. The edge 440 provides a taper which contacts the control rod. The arrangement of FIG. 5 shows the control knob 440 rotated to enable the control rod 308 to attain its neutral or vertical position. As the rod 308 is deflected, the valve 304 is opened by degree. Thus, the control knob 438 is rotated in a manner forcing the control rod 308 away from its neutral position thereby increasing the gas passed by the metering valve 304.

To this juncture, it will be understood how the control knob 440 serves as a single function control subject to setting by the operator. In addition, the device is preferably made temperature responsive. To this end, attention is directed to FIG. 6 where the numeral 444 identifies a chamber which is filled with a fluid. The fluid has a high positive coefficient of expansion with respect to temperature. As it expands, it forces a push rod 446 outwardly. The fluid is within a closed chamber. Thus, expansion of the fluid is converted into linear movement of the push rod 446. The mechanism 444 is received within the cylindrical body 430 against an internal shoulder 448 which is held in position by a snap ring 450.

The push rod 446 connects to a longer push rod 454. The rod 454 has an encircling shoulder 456. The shoulder 456 receives a return spring 458 forcing the rod 454 to the right of FIG. 6. This serves as a return mechanism. The tubular body 430 receives a snap ring 462 which locks in position an internal spool 464.

As described to this juncture, expansion of liquid in the container 444 moves the push rod 446 to the right which movement is then coupled to a larger rod 454. All of this is accomplished against a return spring 458 which returns the mechanism to the right. The rod 454 incorporates an elongate slot 470 which captures the control 308. This sets the control rod and may in fact override the setting on the control knob 438. More importantly, the control rod 308 observed to be captured in the slot 470. This limits its movement to the right or in a direction increasing the opening of the valve. In addition, it is controlled on movement to the left as viewed in FIG. 6. A set screw 472 threads into the end of the rod and protrudes into the slot 470. The set screw can be adjusted to set the operating rate of the pump of the present invention for a specified temperature. This particularly will serve as the minimum rate for that particular temperature. Of course, it can be overriden to a larger value by rotation of the knob 438.

When the liquid in the container 444 is cooled, the rod 454 moves to the right. The slot 470 is also moved to the right. This increases the opening of the metering valve 304.

The temperature responsive apparatus described above is particularly useful for injection of inhibitors preventing hydration in pipelines. Thus, as the temperature increases, the tendency to form hydrates is reduced, thereby reducing the amount of additives required. Operation in the opposite direction can be obtained by utilizing a negative temperature coefficient liquid in the container 444. That is, as the liquid is cooled, the rod is extended rather than retracted. In the alternative, the rod 454 can be elongated so that the slot 470 is located to the left side of the neutral position of the control rod 308. As described in the above mentioned copending application, the control rod 308 can be deflected on both sides of its neutral position. Thus, movement of the rod 454 to the left past neutral will serve to increase the metered flow rate from the valve 304. If this is desired, the conrol 438 can be located to the right of the control rod.

The control system 300 shown in FIGS. 4, 5 and 6 is particularly adapted for use with a hydration inhibitor injector device for use in pipelines. To this end, it is made responsive to outside or ambient air temperature. If desired, it can be made responsive to other temperatures such as temperature of the gas in the pipeline proper. To this end, the mechanism shown in FIG. 6 would have to be maintained at the same temperature as the gas in the pipeline. This is relatively easily accomplished by communicating the two with a heat sink.

It is possible to remove the resilient, dished member and substitute one of similar size and shape to either change resistance to pumping by a change of durometer or to install a rubber having a larger or smaller capacity. In the event pumping pressures become too high, there is some chance of extruding the rubber into the passage in the opposing face. This can be avoided by using a plurality of small passages which branch and intersect the exposed face at a number of diverse locations. Of course, all the small passages would still utilize the same check or relief valve.

The foregoing is directed to the preferred embodiment of the present invention and particularly includes three different embodiments of the present invention and a control system therefor. Many other alterations and modifications may be incorporated but the scope is determined by the claims which are as follows.

What is claimed is:

1. A pump comprising a resilient solid body of specified body size and having an exposed face;

an opposing member formed of a material relatively harder than said resilient body, said opposing member further having an exposed working face opposing the face of said resilient body;

an encircling peripheral shoulder on said resilient solid body which resiliently seals against said opposing member;

a generally circular cavity formed in one of said faces interiorally of said shoulder which seals about said cavity to capture without escape a fluid therein to be pumped, said cavity being closed to capture fluid by said resilient solid body on reciprocating said working face relative to the face of said resilient solid body, said cavity being sufficiently shallow in comparison with the size of said resilient solid body to enable said body to resiliently collapse into the cavity to thereby reduce the volume of said cavity within said shoulder to pump fluid from said cavity wherein the reduction of volume is substantial by all of the volume and is a function of the relative movement of said faces toward one another;

means for positioning said resilient solid body and said working face at a specified location relative to one another;

an outlet passage means opening from said cavity providing an escape path for fluid pumped from said cavity when said cavity is reduced in volume;

means adapted to capture a fluid to be pumped in the vicinity of said opposing faces so that said cavity is at least partly filled with fluid;

means for relatively moving said opposing faces in repetitive pumping motion toward one another, said cavity capturing fluid between said faces inside said shoulder to pressure fluid in a pumping action flowing into said outlet passage means;

said moving means comprising a generally circular chamber divided into two portions by a diaphragm thereacross;

a port opening into said chamber for introducing fluid under pressure to said chamber to move said diaphragm;

a plate-like member contacted against said diaphragm to be moved by said diaphragm;

a piston rod connected to said plate-like member;

a body surrounding said piston rod and connected to said chamber;

a seal means cooperative with said body and said piston rod for sealing against leakage therepast;

said seal means being constructed and arranged such that one end of said piston rod is exposed within a generally closed internal cavity within a housing therein said cavity comprises a portion of said capturing means for fluid;

said moving means including an encircling hollow sleeve about said resilient member and slidably on an end of said piston rod, said sleeve exposing the face of said resilient member.

2. The pump of claim 1 including a check valve means cooperative with said passage means to limit flow therethrough.

3. The pump of claim 1 including a movable piston rod imparting reciprocating motion to said resilient member.

4. The pump of claim 3 including a diaphragm within a closed chamber operatively connected to said piston rod for moving said piston rod.

5. The pump of claim 1 wherein said capture means includes a generally closed container receiving fluid therein which container has an inlet opening adapted to receive fluid therethrough.

6. The pump of claim 1 including a surrounding housing, said passage means extending through said housing to an outlet thereon, and means constructed and arranged to respond to flow of pumped fluid in said passage means past a specified point to form an external indication of the operation of the pump, said means forming a different indication on the absence of flow.

7. The pump of claim 1 including an elongate housing;

an elongate piston rod in said housing;

means for reciprocating said piston rod;

means dividing at least a portion of said housing into a separate chamber apart from the remainder thereof;

said dividing means including sealing means for isolating said chamber for fluid integrity; and, opening means in said housing for introducing the fluid to be pumped into said chamber.

8. The pump of claim 1 including container means incorporating said opposing member and including an opening therein for receiving the fluid to be pumped in said container means;

a movable piston rod extending into said container means;

means for securing said resilient member relative to said piston rod for movement relative to said opposing member;

means connected to said piston rod for moving said piston rod; and, means controlling the rate of operation of said last named means.

9. The pump of claim 1 wherein a generally enclosing housing incorporates said opposing member;

said moving means including a piston rod movably received in said housing;

means for connecting said resilient member to said piston rod to receive movement imparted therefrom;

means connected to said piston rod for moving said piston rod; and, a flexible seal member connected to said piston rod and sealing a portion of said housing to prevent leakage from at least a portion of said housing.

* * * * *